US007600333B2

(12) United States Patent
Robinson, Jr. et al.

(10) Patent No.: US 7,600,333 B2
(45) **Date of Patent: *Oct. 13, 2009**

(54) GOLF SHOE CLEAT

(75) Inventors: Douglas K. Robinson, Jr., Mansfield, MA (US); John J. Erickson, Brockton, MA (US); James M. Feeney, Marion, MA (US); Hetal Dave, Framingham, MA (US)

(73) Assignee: Acushnet Company, Fairhaven, MA (US)

( * ) Notice: Subject to any disclaimer, the term of this patent is extended or adjusted under 35 U.S.C. 154(b) by 471 days.

This patent is subject to a terminal disclaimer.

(21) Appl. No.: 11/528,135

(22) Filed: Sep. 27, 2006

(65) Prior Publication Data

US 2008/0072459 A1 Mar. 27, 2008

(51) Int. Cl.
*A43C 13/04* (2006.01)
*A43B 5/00* (2006.01)

(52) U.S. Cl. ..... 36/134; 36/67 D; 36/127

(58) Field of Classification Search ..... 36/134, 36/67 D, 127, 59 C; D2/962
See application file for complete search history.

(56) References Cited

U.S. PATENT DOCUMENTS

| | | | | |
|---|---|---|---|---|
| 5,926,980 | A | 7/1999 | Adam | |
| 5,940,993 | A | 8/1999 | Ronci | |
| 5,960,568 | A * | 10/1999 | Bell et al. | 36/134 |
| 5,964,048 | A * | 10/1999 | Shieh | 36/134 |
| 5,979,083 | A | 11/1999 | Robinson et al. | |
| 6,023,860 | A | 2/2000 | McMullin | |
| 6,138,386 | A | 10/2000 | Singer et al. | |
| 6,154,984 | A | 12/2000 | Adam | |
| 6,167,641 | B1 | 1/2001 | McMullin | |
| 6,233,850 | B1 | 5/2001 | Peabody | |
| 6,305,104 | B1 | 10/2001 | McMullin | |
| 6,381,878 | B1 | 5/2002 | Kennedy, III et al. | |
| 6,474,003 | B2 | 11/2002 | Erickson et al. | |
| 6,502,332 | B1 | 1/2003 | Nakayama | |
| 6,631,571 | B2 * | 10/2003 | McMullin | 36/134 |
| 6,708,426 | B2 | 3/2004 | Erickson et al. | |
| 6,834,445 | B2 * | 12/2004 | McMullin | 36/127 |
| 7,076,894 | B2 * | 7/2006 | Santos et al. | 36/134 |
| 2002/0152643 | A1 * | 10/2002 | Kim | 36/127 |
| 2006/0059723 | A1 | 3/2006 | Robinson et al. | |
| 2007/0277399 | A1 * | 12/2007 | Dow et al. | 36/134 |

* cited by examiner

*Primary Examiner*—Jila M Mohandesi
(74) *Attorney, Agent, or Firm*—D. Michael Burns

(57) ABSTRACT

The present invention is directed to a three-component releasable mounted cleat assembly for interlocking into a receptacle of a golf shoe. A locking component is biasly inserted into an open receptacle in the shoe and has a geometric construction of downwardly extending tongues causes a requirement for a greater torque remove the cleat than was necessary to install it. An outer component which is coupled to the locking component provides a plurality of rigid posts extending outward for firmly gripping turf. The posts have an exterior wall surface extending vertically from a base and are confined within the outer perimeter of the base. An inner component is secured within the outer component and has a plurality of resilient legs extending outward in a radial direction and originating from a central area of the component.

13 Claims, 4 Drawing Sheets

GOLF SHOE CLEAT

FIELD OF THE INVENTION

This invention relates generally to athletic shoes, particularly to releasable mounted cleats for the use on outsoles of golf shoes. More specifically, the cleats are of a three-component design with a plurality of resilient legs originating from a center area of the cleat.

BACKGROUND OF THE INVENTION

Damage to golf greens, as well as to the wooded floors and carpets of golf clubhouses, caused by golfers wearing athletic shoes with metal spikes is a well-known phenomenon. The need for improved traction on turf surfaces must be tempered with the adverse affect that large metal spikes have upon the turf of golf courses, especially the putting green surface. The protruding metal spike common to golf shoes has systematically been replaced by alternative spike and traction cleats which provide less damage to golf courses. In fact, many golf courses have completely banned the use of metal spikes. Besides the aggravation that golfers feel when having to putt through spike marks left on the putting surface, metal spikes affect groundskeepers who at the end of the day must spend numerous hours repairing the putting greens.

In response to alleviating the foregoing problems which are intrinsic to metallic spikes, shoe manufacturers are providing golf shoes having non-metallic cleats (plastic spikes). The need for improved traction on turf surfaces, while playing golf, is a major concern, however, it is often perceived by many users that plastic cleats are less proficient than metal spikes in ground gripping ability, thus there is a great need for a plastic cleat with superior traction, not just on a golf course, but safety traction on non-grass and non-sand terrain, such as steps, asphalt, tile oak and other types of flooring which golfers have to transverse. Plastic cleats generally have protrusions which are shorter than conventional metallic spikes and since such cleats absorb shocks from hard surfaces to a certain degree, they thereby provide wearers with improved comfort. Plastic cleats also provide improved stability because they are shorter and have a larger number of contact points than shoe soles with conventional metallic spikes. However, as previously stated, such conventional plastic cleats do not generally provide as good grip or bite on grass or turf as metallic spikes do, and providing good grip on grass is what is expected of cleats and spikes. Conventional plastic cleats especially fail against metal spikes in providing grip on wet grass, withered grass or slopes. The plastic cleats are known to be far more difficult to keep clean, which is a concern of golfers playing in adverse weather conditions. Some manufacturer's recognize this problem and supply special cleaning tools for keeping the spikes clean of debris.

The present invention presents an improved plastic cleat that provides a solution for these problems.

SUMMARY

In accordance with one aspect of this invention, a three-component cleat assembly is presented that includes a locking component, an outer component, and an inner component. The locking component interlocks with an open receptacle located in the sole of an athletic shoe or more specifically a golf shoe. The inner component interlocks the outer component to the locking component to form the cleat.

The invention includes a plurality of relatively hard and rigid posts that extend from the outer component, while geometrically remaining within an outer perimeter of the cleat to firmly grip the turf. The cleat also includes a plurality of resilient legs that extend outwardly in a radial direction originating from a center area of the top face of the inner component and these legs grip the turf to provide a golfer with improved traction with the turf.

The inner component includes a connecting element having an elongated cylindrical body of a size to squeeze-fit through a central opening defined in the locking component thus connecting all the components into a single operative cleat. A slotted groove at the distal end of the connecting element aids to allow a squeeze-fit in the locking component.

Another aspect of the invention provides for an interlocking of the cleat assembly to the open receptacle of the shoe by means of an insertion element extending from the locking component. This insertion element screws into the shoe receptacle while a plurality of spaced apart flexible frangible lock tongues extending downward about a bottom surface edge of the disk, compression-fit within the open receptacle of the shoe. When the locking component is rotated in a first direction within the open receptacle, each of the lock tongues are biased into a retracted position against the open receptacle and then re-extend themselves once the locking component has been rotated in the first direction through about 60 degrees. The lock tongues have a cam surface to aid in screwing the cleat into the receptacle and they have a vertical surface that insures that a greater force must be applied to remove the cleat assembly than to install it.

DETAILED DESCRIPTION OF THE INVENTION

Figure 1:
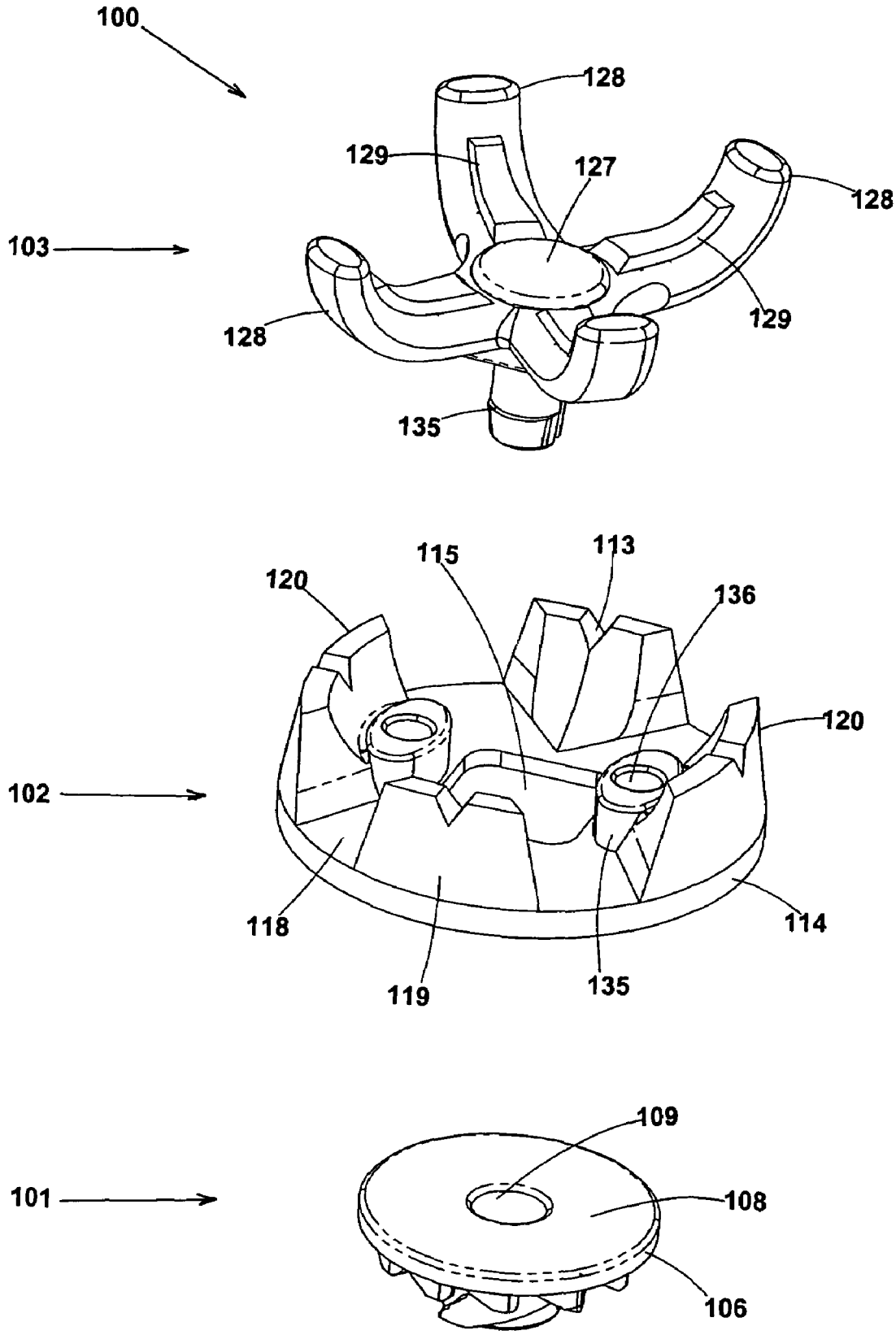
FIG. 1 is an exploded view of a four-component cleat assembly for golf shoes, wherein the cleat assembly is shown from the top position.

Referring now to the drawings, an improved cleat assembly (also referred to as "cleat") is indicated generally by the reference numeral 100. The cleat assembly 100 comprises three components: a locking component 101, which is adapted for interlocking to an open receptacle on an athletic shoe, preferably a golf shoe (the attaching mechanism of the shoe is not shown but examples of the shoe and receptacle pattern are presented in U.S. Pat. Nos. 6,708,426 and 6,474,003, both of which are herein referenced in their entirety); an outer component 102 having substantially rigid means (discussed later) for engaging the turf; and an inner component 103, which includes resilient means for gripping the turf. The inner component 103 having a connecting element 104 that penetrates through the outer component 102 to friction fit within the locking component 101 to form the single cleat assembly 100. The outer and inner components 102 and 103 are preferably fabricated from a pliable thermoplastic urethane having a Shore A hardness in the range of 80 to 100 with 98 preferred. The locking component 101 is preferably made of a firm thermoplastic or nylon with a hardness of about 70D.

Figure 2:
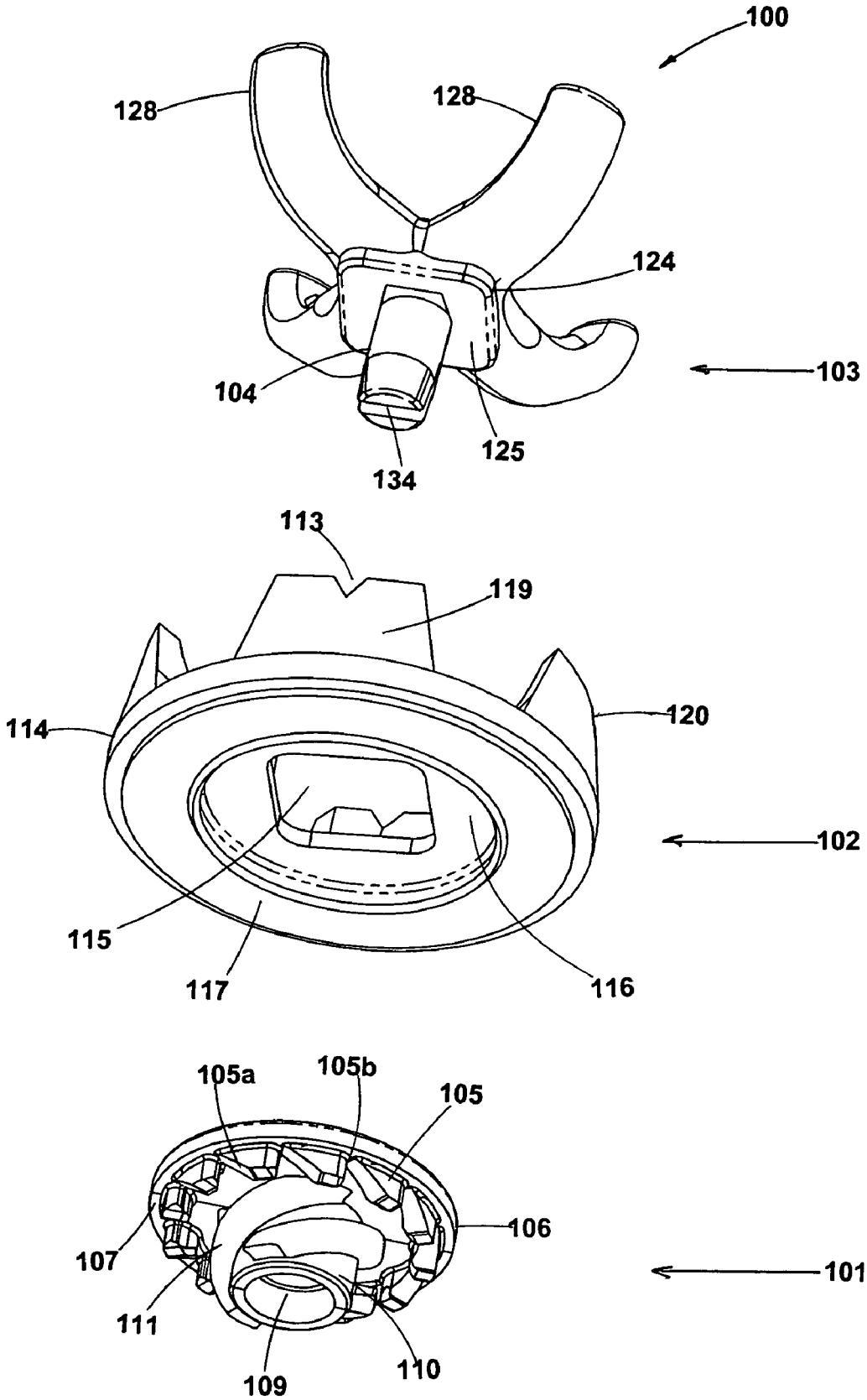
FIG. 2 is an exploded view of the four-component cleat assembly of FIG. 1, shown in a bottom perspective view.
Figure 3:
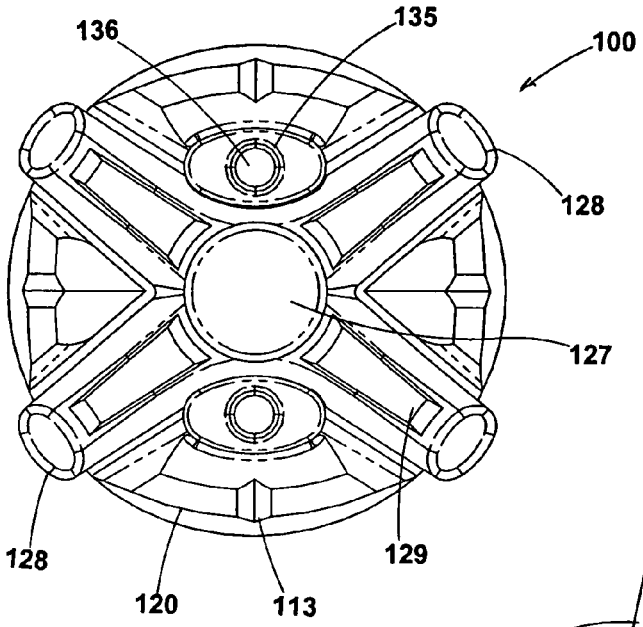
FIG. 3 is a plan view of the top side of the four-component cleat assembly when in an assembled state.
Figure 5:
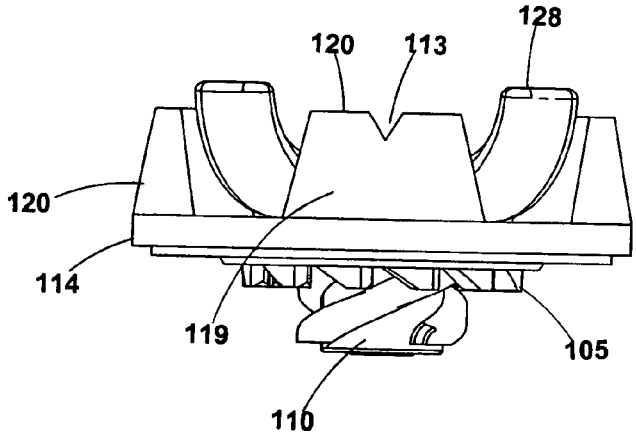
FIG. 5 is an elevation view of the cleat assembly of FIG. 1, with the gripping components at the top.
Figure 4:
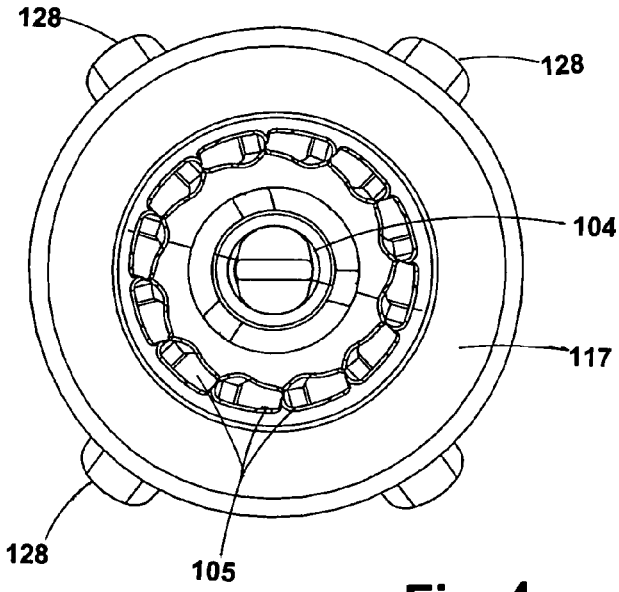
FIG. 4 is a plan view of the bottom (attachment) side of the cleat assembly of FIG. 1.
Figure 6:
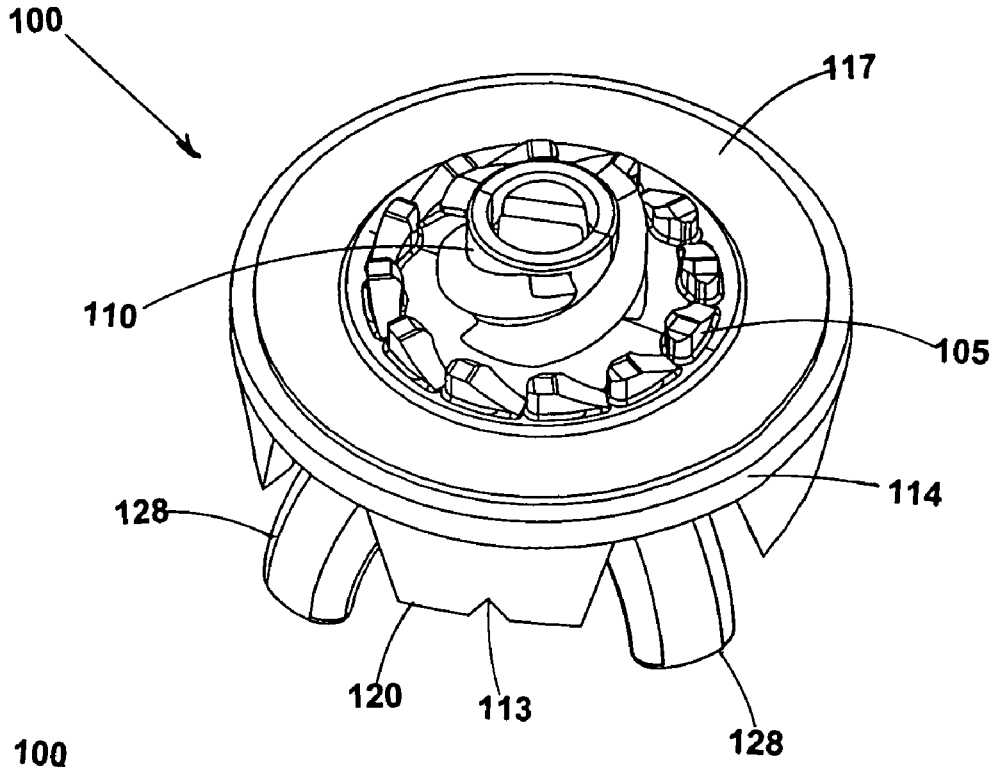
FIG. 6 is a bottom perspective view of the cleat assembly.
Figure 7:
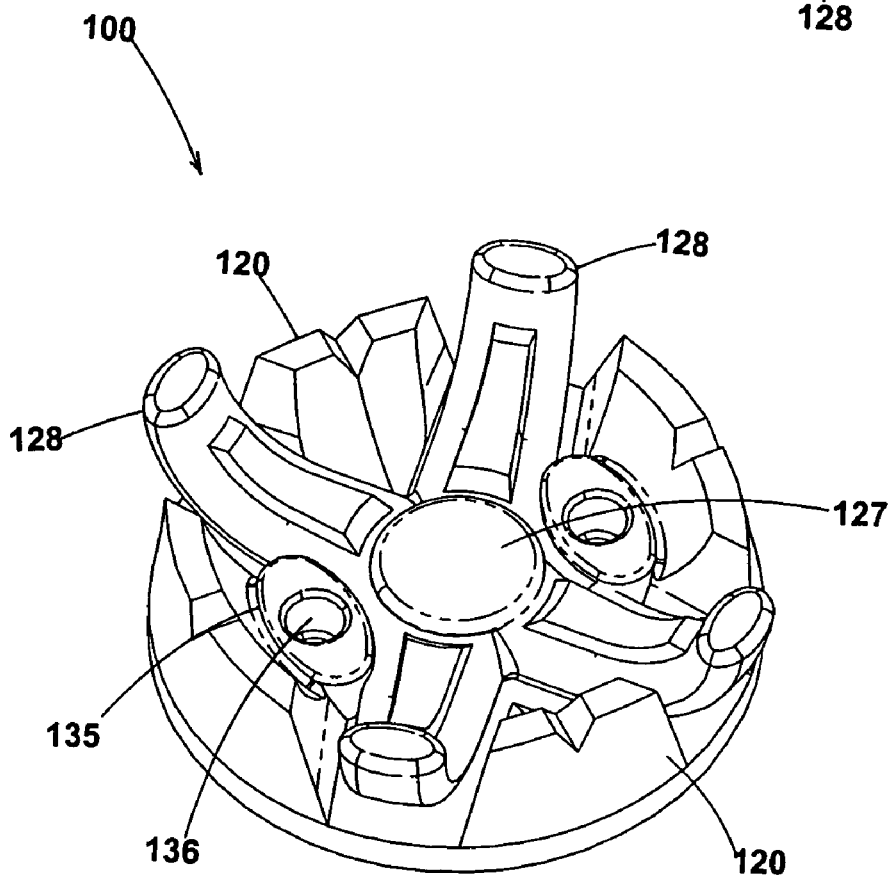
FIG. 7 is a to perspective view of the cleat assembly.

As is illustrated in FIGS. 1 to 7, the cleat assembly 100 includes the locking component 101 that may be engaged within one of a plurality of open receptacles (not shown) which are mounted in the sole of a golf shoe. The number of open receptacles in the golf shoe may vary, but a preferable number would be about five or seven in the forefoot section and about two or four in the heel section. For purposes of clarity, this specification will denote "bottom" when referring to that part of the cleat assembly 100 attaches to the sole of the shoe, and "top" as that part of the cleat assembly 100 which engages the turf.

The locking component 101 has a generally circular disk 106 with a bottom surface 107 and a flat top surface 108, and a round opening 109 defined approximately in the center of the disk 106 for receiving in a friction fit the connecting element 104 of the inner component 103. Locking component 101 further has a cylindrically shaped insertion element 110 that contains a spiraling thread 111 for screwing into one of the open receptacles of the golf shoe. A golf cleat tool (several versions are well known in the industry and therefore not shown) is usually preferred for installing and removing of the cleat assembly 100 in the shoe receptacle. Once inserted into the receptacle, the cleat assembly 100 is rotated clockwise about a centerline of the insertion element 110 through to an angle of approximately 60 degrees wherein it is locked into position. The locking component 101 also includes a plurality of flexible lock tongues 105 that extend in a spaced manner outwardly about the outer edge of a bottom surface 107 of the disk 106. The original shape of each lock tongue 105 includes a cam surface 105*a* and a non-cam vertical surface 105*b*. When the cleat 100 is initially being screwed into the shoe receptacle, the lock tongues 105 are of a dimension and size that they just clear a side rib in the shoe receptacle (not shown). After cleat 100 has been rotated a slight amount further, then the lower edge of the locking component 101 is just above the upper rim of the shoe receptacle, and the lock tongues 105 are then deformed by a cam action provided by the lock tongue cam surfaces 105*a* which "ride" over projections that are in the shoe receptacle. Upon being further turned, the lock tongues 105 pass by the projections in the receptacle until a tight fit is achieved; they then restore themselves (to some extent) to their original shape. Each expendable tongue 105 will pass against, be deformed by, and pass over a number of receptacle projections. The interference between projections in the receptacle and the lock tongues 105 holds the cleat 100 in place during shoe use. When the insertion element 110 has been fully rotated, these lock tongues 105 re-extend themselves into appropriate pockets disposed in the shoe receptacle. The construction of these receptacles conforms to the dimensions of the lock tongues 105. The geometric construction and locking action provided by this interaction requires one to apply greater torque to remove the cleat assembly 100 than to install it.

The outer component 102 has a generally circular base 114 with a rectangular slot 115 passing through the center of the base 114 (the function for which will be discussed later). A plurality of posts 120, preferably four, are spaced equally about and project away from the top surface 118 of the base 114 so as to provide for rigid attachment to the turf. The posts 120 are relatively rigid and a notch 113 is defined in a distal end of each post 120. The shape at the distal end of each post 120 is relatively flat or blunted. The exterior wall surfaces 119 are generally perpendicular to the plane of the top surface 118 and do not extend beyond the exterior perimeter of the base 114. Extending away from the top surface 118 of the base 114 are two oval shaped tool sheaths 135 which are at a distance apart so as to accommodate the insertion of a standard golf cleat tool. The cleat tool has a pair of prongs that can be inserted into a circular hole 136 of each sheath 135 and when rotated clock-wise the cleat will be fastened to the shoe or if rotated counter-clockwise the cleat will be removed. A bottom face 117 of the base 114 has a recess 116 that is of a size and dimension to friction fit over the outer perimeter of the circular disk 106 of the locking component 101.

A major improvement provided by the present invention is the construction of the inner component 103. This component includes a plate 124 having flat bottom face 125 of a size and shape for fitting into the rectangular slot 115 of the outer component 102, such that the inner component 103 is integrally secured within the outer component 102. The top face 127 is of a circular shape from which a plurality of arcuately shaped resilient legs 128, preferably four, extend outward in a radial direction for increase gripping of the turf. Each leg 128 has a wing-shaped spoiler 129 for extra strength and to aid in the debris removing and also to help prevent a build-up of turf that often clogs cleat assemble 100. Extending downward from the bottom of the inner component is the connecting element 104 having a cylindrical body of a size and shape configured to friction-fit through the round opening 109 of the locking component 101 to secure all components into a unitary cleat assembly 100. A slotted groove 134 is formed in the insertion end of the connecting component 104 to aid in the friction-fitting of the components 103, and 101. A lip 135 is located at the insertion end to secure the components when the connection component 104 is fully extended through the cleat assembly 100.

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

We claim:

1. A removable cleat assembly for interlocking with an open receptacle in a golf shoe, the cleat assembly comprising:

a locking component having a generally circular disk having a centrally located round opening defined therein, and an insertion element for interlocking to the open receptacle;

an outer component having a bottom face defining a recess of a size and configuration to friction fit over the circular disk of the locking component; the outer component having a rectangular slot defined through a central portion, and having a plurality of equally spaced rigid posts for gripping the turf, the outer dimensions of the posts maintained within the perimeter of the base;

an inner component having a plate of a size and shape for friction fitting within the rectangular slot of the outer component and a connecting element having a cylindrical body of a size and shape configured to friction-fit through the round opening of the locking component and having a plurality of resilient legs originating from a center area on a top face and extending outward in a radial direction for increased gripping of the turf, wherein all components are connected to form the unitary removable cleat assembly.

2. The cleat assembly according to claim 1, wherein the locking component comprises:

the insertion element extending perpendicularly downward from a bottom surface of the disk, the insertion element having a spiraling thread for screwing into the open receptacle of the golf shoe, a plurality of flexible lock tongues extending in a spaced manner downward about an edge of the bottom surface of the disk for compression-fitting within the open receptacle of the shoe, the lock tongues having a cam surface one side and a vertical surface on an opposite side, wherein as the locking component is rotated in a first direction within the open receptacle, each of the lock tongues are biased into a retracted position against the open receptacle and then restore themselves once the locking member has been rotated in the first direction through about 60 degrees, such that a greater force must be applied to remove the cleat assembly than to install it.

3. The cleat assembly according to claim 2, wherein the locking component is made from a firm thermoplastic or nylon with a hardness of about 70D.

4. The cleat assembly according to claim 1, wherein the plurality of posts comprises four posts.

5. The cleat assembly according to claim 4, wherein each post has a notch defined in the distal end for increased gripping action.

6. The cleat assembly according to claim 1, wherein the plurality of resilient legs are arcuately shaped and have a spoiler for added structural reinforcement and for aiding in removing debris.

7. The cleat assembly according to claim 6, wherein the plurality of resilient legs are four.

8. The cleat assembly according to claim 7, wherein each of the resilient legs is disposed between adjacent posts of the outer component.

9. The cleat assembly according to claim 1, wherein the inner component is made from a pliable thermoplastic urethane having a Shore A hardness in a range from 80 to 100.

10. The cleat assembly according to claim 1, wherein a slotted groove is defined in the bottom end of the connecting element for aiding in friction-fitting to the locking component.

11. A three-component cleat assembly, the cleat assembly comprising:

(a) a locking component including:

a disk having a centrally located opening defined therein, and an insertion element for interlocking the locking component within an open receptacle of a golf shoe;

(b) an outer component comprising:

a base having a bottom face defining a lower recess of a size and configuration for friction fitting over the circular disk of the locking component;

a slot defined in the base, and a plurality of rigid posts extending upwards from a top surface of the base; and (c) an inner component comprising:

a generally rectangular plate of a size and shape for fitting immovably within the slot of the outer component, a plurality of resilient legs originating from a circular area of a top face of the plate, the legs extending outwardly in a radial direction, each leg located between adjacent posts of the outer component; and a cylindrical connecting element extending downward from a bottom surface of the plate, the connecting element of a size and shape for friction fitting to the locking component to form the unitary cleat assembly.

12. The cleat assembly according to claim 11, wherein the insertion element of the locking component comprises:

a plurality of spaced flexible lock tongues extending downward about a bottom surface edge of the disk for compression-fitting within the open receptacle of the shoe, wherein as the locking component is rotated in a first direction within the open receptacle, each of the lock tongues are biased into a retracted position against the open receptacle and then re-extending themselves once the locking component has been rotated in the first direction through about 60 degrees, such that a greater force must be applied to remove the cleat assembly than to install it.

13. The cleat assembly according to claim 11, wherein the plurality of posts comprises four posts.

* * * * *